US008783187B2

(12) United States Patent
Amick

(10) Patent No.: US 8,783,187 B2
(45) Date of Patent: Jul. 22, 2014

(54) FIREARM PROJECTILES AND CARTRIDGES AND METHODS OF MANUFACTURING THE SAME

(75) Inventor: Darryl D. Amick, Albany, OR (US)

(73) Assignee: Amick Family Revocable Living Trust, Albany, OR (US)

( * ) Notice: Subject to any disclaimer, the term of this patent is extended or adjusted under 35 U.S.C. 154(b) by 567 days.

(21) Appl. No.: 13/023,727

(22) Filed: Feb. 9, 2011

(65) Prior Publication Data

US 2011/0203477 A1 Aug. 25, 2011

Related U.S. Application Data

(60) Provisional application No. 61/337,614, filed on Feb. 9, 2010, provisional application No. 61/440,572, filed on Feb. 8, 2011.

(51) Int. Cl.
*F42B 12/00* (2006.01)
*F42B 30/02* (2006.01)
*F42B 33/00* (2006.01)

(52) U.S. Cl.
CPC ..... *F42B 30/02* (2013.01); *F42B 33/00* (2013.01)
USPC ..... 102/517; 86/55

(58) Field of Classification Search
USPC ..... 102/501, 214, 516, 517, 293; 86/54, 55
See application file for complete search history.

(56) References Cited

U.S. PATENT DOCUMENTS

| | | | | | |
|---|---|---|---|---|---|
| 3,208,386 | A | * | 9/1965 | Schneider et al. | 102/506 |
| 4,655,140 | A | * | 4/1987 | Schirneker | 102/508 |
| 5,009,166 | A | * | 4/1991 | Bilsbury et al. | 102/516 |
| 5,131,123 | A | | 7/1992 | Brooks | |
| 5,394,597 | A | * | 3/1995 | White | 86/55 |
| 5,463,960 | A | * | 11/1995 | Lowry | 102/501 |
| 5,569,874 | A | | 10/1996 | Nelson | |
| 5,679,920 | A | | 10/1997 | Hallis et al. | |
| 5,794,320 | A | * | 8/1998 | Wernz et al. | 86/55 |
| 5,852,255 | A | * | 12/1998 | Hallis et al. | 102/439 |
| 5,894,645 | A | * | 4/1999 | Hallis et al. | 86/55 |
| 5,943,749 | A | * | 8/1999 | Swank | 86/54 |
| 6,447,715 | B1 | | 9/2002 | Amick | |
| 6,749,802 | B2 | | 6/2004 | Amick | |
| 6,823,798 | B2 | | 11/2004 | Amick | |
| 6,938,552 | B2 | * | 9/2005 | Tom et al. | 102/517 |
| 7,487,727 | B2 | * | 2/2009 | Eberhart et al. | 102/510 |
| 2003/0101891 | A1 | | 6/2003 | Amick | |
| 2011/0088537 | A1 | * | 4/2011 | Eberhart | 86/55 |

* cited by examiner

*Primary Examiner* — Benjamin P Lee
(74) *Attorney, Agent, or Firm* — Dascenzo Intellectual Property Law, P.C.

(57) ABSTRACT

Firearm projectiles and methods of manufacturing firearm projectiles from a supply of clad wire. In some embodiments, the clad wire is manufactured as electrical wire, such as copper-clad steel wire. Bullets and shot, as well as methods of forming bullets and shot, from clad wire are disclosed.

34 Claims, 2 Drawing Sheets

FIREARM PROJECTILES AND CARTRIDGES AND METHODS OF MANUFACTURING THE SAME

RELATED APPLICATIONS

The present application claims priority to U.S. Provisional Patent Application Ser. No. 61/337,614, entitled "NON-TOXIC PROJECTILES AND METHODS UTILIZING 'CLAD STEEL' WIRE," which was filed on Feb. 9, 2010, and to U.S. Provisional Patent Application Ser. No. 61/440,572, also entitled "NON-TOXIC PROJECTILES AND METHODS UTILIZING 'CLAD STEEL' WIRE," which was filed on Feb. 8, 2011. The complete disclosures of these two provisional patent applications are incorporated herein by reference.

FIELD OF THE DISCLOSURE

The present disclosure relates generally to the field of firearm ammunition and more specifically to bullets, shot, and firearms cartridges, as well as to methods of manufacturing the same.

BACKGROUND OF THE DISCLOSURE

Perhaps no other subject pertaining to adverse impacts on wildlife by human activity has generated more global concern and response during the past decade than the well-documented occurrences of poisoning in a wide variety of avian (and other) species by incidental ingestion of lead (Pb), almost entirely attributed to spent ammunition. For example, approximately 150 professional bioscientists from throughout the USA, Canada, Europe, Australia, et al. met during May 12-15, 2008 in Boise, Id. at a conference sponsored by The Peregrine Fund, United States Geological Survey, Tufts Center for Conservation Medicine and Boise State University, and entitled, "Ingestion of Lead from Spent Ammunition: Implications for Wildlife and Humans."

While no attempt will be made herein to discuss the 53 invited technical presentations at the Boise conference, it is relevant to offer brief examples of general consensus among the participants:

(1) Outlawing of lead shot for hunting waterfowl in the U.S. and Canada has drastically reduced losses of ducks, geese, et al. by lead poisoning and has not contributed to other types of loss (for example, by crippling due to steel shot). Serious consideration is being given throughout the U.S. to extending the ban on lead shotgun shot to other types of bird and small-game hunting. While steel shot is considered to be acceptable for its intended purpose, it should be noted that it is only considered to be appropriate for modern shotguns with relatively hard steel barrels. It is therefore not recommended for a wide spectrum of older, fine-quality guns manufactured prior to the modern prohibitions against toxic lead shot. This factor is quite relevant to some embodiments of the present disclosure.

(2) Voluntary restriction of the use of lead bullets for big-game hunting was not sufficiently effective in the condor range of California, but produced somewhat better results in Arizona and Utah. Both scavengers and raptors eat carrion, such as that associated with lead-killed animals.

(3) California will continue to enforce its July 2008 mandatory statewide ban on lead bullets (including not only "centerfire" big-game and varmint bullets, but also smaller "rimfire" bullets for target and varmint shooting).

(4) Other U.S. states and many foreign countries are presently in various stages of studying further lead bullet restrictions, and some countries have already instituted new policies and/or laws.

(5) While as yet unproven, there is evidence that game meat contaminated with small lead fragments may constitute an unnecessary risk to humans who knowingly or innocently ingest them. This concern, whether fully justified or not, has resulted in warnings to the public by governmental health agencies and in curtailment of distribution of game meat to charitable agencies and organizations.

At the present time, bullets comprised primarily of copper (Cu) and copper alloys (e.g., Cu—Zn and Cu—Sn) are the most popular available alternatives to lead. Barnes Bullet Company pioneered a wide spectrum of pure copper bullets, beginning as far back as 1985, as represented in U.S. Pat. No. 5,131,123, the disclosure of which is hereby incorporated by reference. It is relevant to note that the incentive for these efforts was based upon claimed superior bullet ballistic performance, rather than on any consideration of toxicity. Since the California ban, several other manufacturers have offered other types of copper-based bullets, all of which, as already mentioned, contain copper as the primary constituent.

While an interim consensus was evident at the Boise conference that copper was much preferable to lead, actual in vivo tests of American kestrels (the target/study bird selected as representative of raptors and scavengers), in which subject birds have been gavaged (i.e., force-fed) with solid copper samples, are scheduled to be completed sometime during the spring of 2011 by USGS personnel. It should be noted that bullets produced from both solid and particulate forms of copper and its alloys are presently being offered by manufacturers, the different varieties of which may have correspondingly different dissolution rates, toxicities, etc. when ingested by birds or other living creatures.

Aside from toxicological considerations, intensive debate continues among sportsmen and wildlife personnel as to the impact of additional costs associated with non-toxic, copper-based ammunition, especially in such areas as varmint and/or target shooting, sports in which relatively large numbers of cartridges are expended. Copper bullets typically cost several times as much as traditional copper-jacketed lead bullets, a factor which is perceived as potentially reducing the number of hunters/shooters, as well as the frequency of their activities. From a conservationist standpoint, hunters who are reluctant or unable to practice their skills are more likely to wound game animals, with resulting waste of the resource.

The dual requirements of non-toxicity and economy argue for development of projectiles made, in whole or in part, from steels. Common grades of steel (for example, in wire/rod form) are available at commodity prices (per unit weight) that are approximately 60% of those of lead and only about 15% of those of copper. Considerations of acute and low-level/long-term toxicity and "environmental fate" also demonstrate attractive attributes of iron and steel. Iron (Fe), the fourth most abundant element on earth, is generally considered to be "environmentally friendly" and easily oxidized to insoluble compounds. No other metallic material can begin to compare with steel from the standpoints of industrial experience, metallurgical technology, product diversity, variety of available process capability, etc. While steel bullet and jacket types have been used in certain military applications (often motivated by war-time shortages of critical materials such as copper and lead), one might well ask why steel bullets have not been applied to a wider variety of bullets, including those suitable for law enforcement and civilian applications.

Whereas military bullets for such common calibers as 0.223 in. (5.56 mm) and 0.30 in. (7.62 mm) are prohibited from expanding ("mushrooming") or fragmenting by international agreements (e.g., The Hague and Geneva Conventions), bullets used for big-game, small-game, and varmint hunting are designed specifically to expand and/or fragment in the target. An exception to this is found in very large African game, for example, elephant or cape buffalo, for which solid brass or other alloy bullets are designed to penetrate heavy skulls. A further consideration in hunting bullets is that they are preferably designed to penetrate and expand in a controlled manner, often specific to particular sizes and/or species of animals. A primary objective is for the bullet to penetrate sufficiently to reach critical organs, while depositing all or most of its energy in vital regions. Premature expansion may result in non-lethal "flesh wounding," while delayed expansion may allow the bullet to pass entirely through the animal, leaving an under-sized wound path and wasting kinetic energy beyond the target.

In law enforcement applications for bullets, penetration and expansion also are important attributes to be controlled. As in hunting applications, it may be desirable for a bullet to expand in such a manner as to deposit all of its kinetic energy in the target, in this case, a human being deemed to be a threat to the lives of peace officers or others. However, the human factor greatly complicates bullet requirements for given situations. For example, a perpetrator may be wearing a variety of clothing (including body armor), which significantly affects bullet expansion and subsequent penetration. This variable is especially important when "hollow point" bullets are employed, since different types of cloth may plug the bullet's nose cavity, thereby preventing it from expanding properly. Police officers also face many situations in which the perpetrator is shielded behind barriers such as automobile windshields, construction materials, panels, etc., situations which could benefit from a highly penetrative bullet. Further complicating the law officer's responsibilities are considerations of bullet over-penetration and ricocheting, both of which may result in injury to bystanders. Because of these and other factors, law enforcement agencies must constantly make potentially "life and death" decisions as to precisely which bullet types represent the best compromise for officers to carry at a particular instance.

Both accuracy and retained energy of bullets are influenced by such factors as bullet density (mass-per-unit-volume), dimensions and shape, as well as variables inherent in gun barrel design (e.g., length, twist rate, etc.) and environment (e.g., air temperature, pressure, humidity, etc.). While bullet density may be directly related to energy retention and fluid drag resistance, the success attained with solid copper bullets (e.g., Barnes Bullets, Inc. products) during the past 25 years illustrates that lower material density need not be viewed as an insurmountable obstacle to acceptable ballistic performance. In fact, several advantages of such bullets have been claimed, including that lighter bullets may be launched at higher velocities (for a given barrel pressure) and therefore may actually display less gravitational drop at certain distances. Another factor is that copper bullets "mushroom" in a manner quite different from conventional lead hunting bullets. In the former, the unfolded bullet "petals" created at impact remain attached to the base of the bullet (thereby retaining integral mass), while lead bullets tend to shed and scatter fragments of lead along the wound path (poor "weight retention"). This characteristic behavior observed in many lead bullets is presumably the result of its extreme softness and low melting point.

Because expanding copper bullets (8.96 g/cc density) perform well enough to satisfactorily substitute for corresponding lead bullets (11 glee density), obtaining acceptable performance with steel bullets also appears to be feasible. The shift in density from lead to copper represents a decrease of about 22%, whereas the difference between steel at 7.86 glee and copper is only about 14%. Appropriate grades of low-carbon steel, properly fabricated in accordance with specific processes and bullet designs, possess sufficient ductility to replicate the "folded petal" behavior of copper, including its inherently high weight-retention, when desired.

Another factor, which cannot be ignored, is that a bullet must possess surface properties such that the machined rifling grooves in modern gun barrels are not prematurely eroded, nor are they filled or "fouled" by bullet residues. With lead-core bullets, fouling is prevented by individually encapsulating cores in copper alloy (often 97% Cu-5% Zn "gilding metal") jackets. These jackets typically are separately formed "housings" into which the bullet core is positioned during production of the assembled bullet. The jacket also contributes significantly to the overall strength of the bullet, which must withstand high rotational and translational stresses without flying apart or "obturating" (i.e., becoming mechanically distorted) in flight. In addition to encapsulating the main bearing surface of the bullet in this way, it is usually necessary to place a "gas check" disc on its rearward face to prevent the melting of lead by hot combustion gases upon firing the cartridge. Other means of coating conventional lead-cored bullets include electrolytic plating (restricted to cartridges with relatively low velocities), non-metallic coatings (e.g., nylon,), and jacketing sub-sized bullets in relatively thick plastic "sabots." Obviously, none of these bullet coating schemes is necessary in the case of solid copper bullets.

While an inexperienced engineer or metallurgist might assume that a metallic shape of basically round cross-section (e.g., a bullet) could be advantageously clad in a different metal by means of a continuous process, resulting in a long clad wire, attempts to do so with lead and copper have proven to be technically and economically impractical. This is believed to be primarily due to the widely different mechanical, physical and metallurgical properties of such dissimilar metals as lead and copper. The overall result of these property differences is that conventional high-velocity bullets must be produced by individually fitting each lead core with a precisely-tailored copper alloy jacket, and then maintaining precision, uniformity, repeatability, etc. throughout all subsequent operations. While many bullet manufacturers make advertising claims of "bonded" bullets, consideration of the Cu—Pb equilibrium diagram illustrates that there is no discernable solid solubility (i.e., "alloying") directly between solid copper and solid lead, indicating that any so-called "bonding" would be metallurgically marginal. Conversely, the Cu—Fe binary system does, in fact, display significant degrees of solid solubility, both in Cu-rich and Fe-rich regions of the alloy system.

Bonding strength between jackets and cores is not a trivial consideration, with respect to both performance and safety. For example, if jacket material is "stripped" from the core as the bullet travels down the gunbarrel, it may become lodged in the barrel, resulting in an obstruction to subsequent firings. Conventional swaged jacket-core assemblies must be held to strict production quality-control standards to ensure adequate bond strengths. Electroplated copper jackets are viewed as having relatively low bonding strengths to degrees that limit their usefulness to low velocities (e.g., in pistols and a few relatively low-power rifles).

In the case of steel shotgun pellets, copper, zinc, and nickel are routinely applied as electroplated films by various manufacturers to obtain some degree of corrosion-resistance, along with aesthetically pleasing surface appearance. These films, however, are relatively thin (e.g., 0.0005-0.001 inch), porous, and merely mechanically bonded to steel substrates. None of these coated steel pellet types is considered to be acceptable for use in older shotguns, the present markets being served by expensive alternatives to lead, such as bismuth.

SUMMARY OF THE DISCLOSURE

The present disclosure is directed to firearm projectiles and to methods of manufacturing firearm projectiles, including bullets and shot. The disclosed methods utilize a source of clad wire to form the projectiles. For example, in some embodiments, the clad wire may be manufactured as electrical wire, such as copper-clad steel wire. In other embodiments, the clad wire may be custom made for the purpose of forming projectiles. In some methods according to the present disclosure, a standard gauge clad wire is reduced in diameter to correspond to a desired diameter of a projectile being formed. In other methods according to the present disclosure, the diameter of a length of standard gauge clad wire is enlarged to correspond to a desired diameter of a projectile being formed. Firearms projectiles formed from clad wire according to the present disclosure may provide stronger bonds, optionally including metallurgical bonds, between the copper and the core metal to which it is clad, and/or may have thicker copper layers than conventional firearm projectiles electroplated with outer copper layers.

DETAILED DESCRIPTION AND BEST MODE OF THE DISCLOSURE

The present disclosure relates both to firearm projectiles, such as bullets and shot, as well as to methods for forming, or manufacturing, firearm projectiles. More specifically, projectiles according to the present disclosure are formed from, and methods according to the present disclosure utilize, clad wire.

Figure 1:
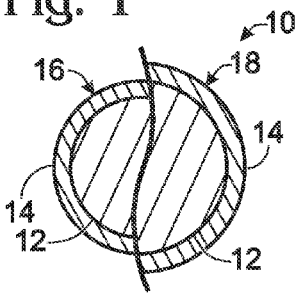
FIG. 1 is a schematic cross-sectional view of two relative sizes of clad wire that may be used to form firearm projectiles according to the present disclosure and that may be used in methods according to the present disclosure.

As used herein, "clad wire" refers to a composite, bimetallic wire having an inner core of a first metal surrounded by an outer layer, or cladding, of a second metal that is bonded to the inner core and that is different than the inner core. FIG. 1 schematically illustrates two cross-sectional representations of clad wire 10, including an inner core 12 and an outer layer, or cladding, 14.

Illustrative, non-exclusive examples of clad wire include (but are not limited to) steel clad wire (i.e., wire with a steel inner core 12 and a non-steel cladding 14). Illustrative, non-exclusive examples of steel clad wire include (but are not limited to) copper-clad steel wire, aluminum-clad steel wire, tin-clad steel wire, and zinc-clad steel wire, all of which may be described as commodity clad steel wire, because such wires are produced in abundance around the globe, such as for electrical wire. Other examples of clad wire are also within the scope of the present disclosure and may be utilized by methods according to the present disclosure to form firearm projectiles, such as bullets and shot, according to the present disclosure.

Copper-clad steel wire, in particular, is used throughout the electrical industry as a less expensive alternative to solid copper wire. Copper-clad steel wire was developed to provide electrical conductors that are much stronger than pure copper but which, nevertheless, retain the relatively high conductivity and corrosion resistance of copper. The various grades of copper-clad steel wire are typically identified in terms of standard AWG (American wire gauge), with additional identifiers pertaining to conductivity relative to that of pure copper (% IACS—International Annealed Copper Standard). For example, at least twenty-eight AWG wire diameters are commonly available in the U.S. with at least three common % IACS values: 21%, 30% and 40%. The % IACS identifier also relates to the relative thickness of the copper cladding of copper-clad steel wire. Specifically, 21% IACS indicates copper thickness equal to 3% of the total diameter of the wire; 30% IACS indicates 6.5% copper thickness and 40% indicates 10% copper thickness. Standard grades of core steels are AISI 1006 (0.06 wt % carbon) and AISI 1022 (0.22 wt % carbon) plain-carbon steels. Other copper-clad steel wire configurations and associated values, as well as other steel grades, are within the scope of the present disclosure and may be used in methods to form firearm projectiles according to the present disclosure.

As an illustrative, non-exclusive example, copper-clad steel wire products for the electrical industry are typically made using thermo-mechanical processing (i.e., metallurgical processes in which combinations of pressure and heat are applied to effect strong, homogeneous diffusion bonds between the steel and copper components). While most such processes currently comprise heating/bonding strips of copper to a steel core-rod by means of heated, counter-rotating rolls, other thermo-mechanical processes such as hot coextrusion of composite copper-steel assemblies, also may be utilized and therefore are included within the scope of the present disclosure.

The following table identifies various diameters of standard AWG clad wire, standard caliber bullets, and standard ammunition shot:

| AWG # (inches) | Bullet Caliber (inches) | Shot # (inches) |
|---|---|---|
| 0 (0.3249) | .375 Mag. (0.375) | OOOO Buck (0.380) |
| 1 (0.2893) | .35 Rem. (0.358) | OOO Buck (0.360) |
| 2 (0.2576) | .338 Mag. (0.338) | OO Buck (0.330) |
| 3 (0.2294) | .30 cal. (0.308) | O Buck (0.320) |
| 4 (0.2043) | 7 mm (0.284) | I Buck (0.300) |
| 5 (0.1819) | .270 Win. (0.277) | 2 Buck (0.270) |
| 6 (0.1620) | .260 Rem. (0.264) | 3 Buck (0.250) |
| 7 (0.1443) | .257 WM, .25-06 (0.257) | 4 Buck (0.240) |
| 8 (0.1285) | .243 Win., 6 mm (0.243) | FF (0.230) |
| 9 (0.1144) | .223 Rem. (0.224) | F (0.220) |
| 10 (0.1019) | .22 (0.223) | TT (0.210) |
| 11 (0.0907) | .17 (0.172) | T (0.200) |
| 12 (0.0808) | | BBB (0.190) |
| 13 (0.0720) | | BB (0.180) |
| | | B (0.170) |
| | | 1 (0.160) |
| | | 2 (0.150) |
| | | 3 (0.140) |
| | | 4 (0.130) |
| | | 5 (0.120) |
| | | 6 (0.110) |
| | | 7 (0.100) |
| | | 8 (0.090) |
| | | 9 (0.080) |

The present disclosure is not limited to the above-identified illustrative, non-exclusive examples of sizes of ammunition projectiles, and other sizes, or calibers, of projectiles are within the scope of the present disclosure (including custom-sized projectiles) and may be formed by methods according to the present disclosure As evidenced in the above table, only a few of the clad wire standard gauges have diameters corresponding approximately to a diameter of a standard ammunition projectile. For example, a #3 AWG clad wire has a diameter of 0.2294 inches, while a .22 caliber bullet has a diameter of 0.223 inches. Similarly, a #FF shot has a diameter of 0.23 inches. A #11 AWG clad wire has a diameter of 0.0907 inches, while a #8 shot has a diameter of 0.090 inches. A #12 AWG clad wire has a diameter of 0.0808 inches, while a #9 shot has a diameter of 0.080 inches. Accordingly, #3, #11, and #12 AWG clad wire may be appropriately sized to form ammunition projectiles according to the present disclosure without a required step of altering, or modifying, the diameter of the clad wire; however, as seen in the above table, most standard ammunition projectiles have diameters that are not equal to, or closely equal to, standard AWG clad wire. Therefore, as discussed herein, methods of forming ammunition projectiles according to the present disclosure may include a step of decreasing or a step of increasing the diameter of a selected clad wire to form a desired size of ammunition projectile. Also within the scope of the present disclosure, however, is to manufacture, or form, clad wire that does not necessarily correspond to a standard AWG and that does have a diameter corresponding to a desired size of ammunition projectile. This manufacturing, or forming, of a non-standard clad wire may be described as manufacturing, or forming, a custom clad wire for purposes of forming ammunition projectiles according to the present disclosure.

The decreasing and increasing of the diameter of clad wire is schematically illustrated in FIG. 1, in which a first clad wire 16 is illustrated having a first diameter together with a second clad wire 18 having a second diameter that is greater than the diameter of the first clad wire. FIG. 1 is not drawn to scale, and therefore does not illustrate specific proportions of inner cores 12 to cladding 14, nor does it illustrate specific increasing and/or decreasing of diameters of clad wire, as may be performed according to methods according to the present disclosure.

The flowcharts in the Figures of the present disclosure schematically represent illustrative, non-exclusive examples of methods 100 of forming ammunition projectiles. Some steps in the flowcharts are illustrated in dashed boxes, with such dashed boxes indicating that such steps may be optional or may correspond to an optional embodiment or version of a method according to the present disclosure. That said, not all methods according to the present disclosure are required to include the steps illustrated in solid boxes. The methods and steps illustrated in the flowcharts are not limiting, and other methods and steps are also within the scope of the present disclosure, including methods having greater than or fewer than the number of steps illustrated, as understood from the discussions herein. Moreover, methods according to the present disclosure are not limited to the illustrated steps being performed in the illustrated order, and variations on the illustrated order are within the scope of methods 100 according to the present disclosure. Additionally or alternatively, one or more steps of one illustrated method of a Figure may be incorporated into another illustrated method of another Figure without departing from the scope of the present disclosure. Moreover, where one illustrated and discussed method includes a step described, named, and/or numbered similarly to another step of another illustrated and discussed method, for the purpose of brevity, each step or variant thereof may not be discussed in detail with respect to each illustrated and discussed method; however, it is within the scope of the present disclosure that discussed features, options, variants, etc. of the various steps of methods discussed herein may be incorporated into any suitable method according to the present disclosure, where appropriate.

Figure 2:
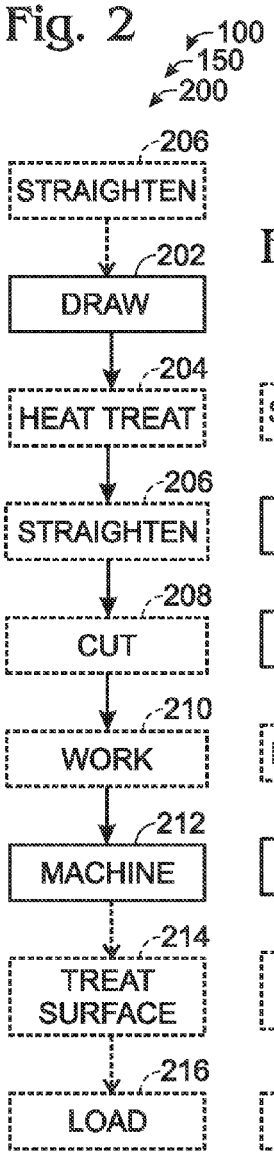
FIG. 2 is a flowchart schematically illustrating illustrative, non-exclusive examples of methods of forming bullets according to the present disclosure.
Figure 5:
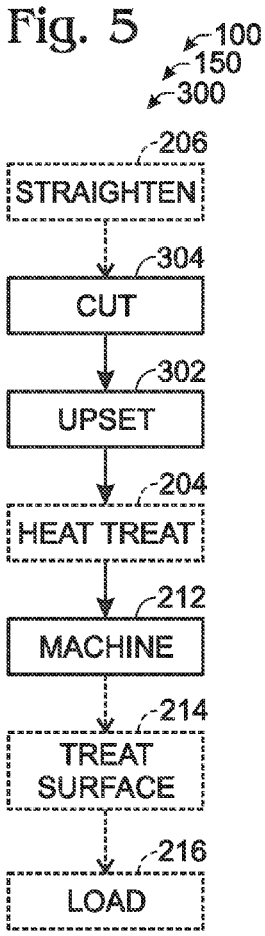
FIG. 5 is a flowchart schematically illustrating additional illustrative, non-exclusive examples of methods of forming bullets according to the present disclosure.

Referring first to the flowcharts of FIGS. 2 and 5, illustrative, non-exclusive examples of methods 100 of forming ammunition projectiles are schematically illustrated. The illustrated methods 100 of FIGS. 2 and 5 are more specifically directed to methods of forming bullets and are indicated generally at 150. As discussed herein, methods of forming ammunition projectiles may include a step of decreasing or a step of increasing the diameter of a selected clad wire to form a desired size of ammunition projectile. The flowchart of FIG. 2 illustrates methods 200 that include a step of reducing the diameter of a selected clad wire, whereas the flowchart of FIG. 5 illustrates methods 300 that include a step of enlarging the diameter of a selected clad wire. These optional steps of decreasing or increasing the diameter of clad wire of methods 150 according to the present disclosure are schematically represented in FIG. 1, in which two diameters of clad wire are schematically illustrated. That is, FIG. 1 schematically illustrates both a reduction of a diameter of a length of clad wire as optionally may be performed according to methods 200 according to the present disclosure, and an increase of a diameter of a length of clad wire as optionally may be performed according to methods 300 according to the present disclosure.

Methods 200 according to the present disclosure may be described as methods of forming bullets in which the diameter of clad wire, such as a standard gauge clad wire, is reduced to correspond to a desired diameter, such as that of a desired caliber bullet to be formed. Accordingly, as illustrated at 202 in FIG. 2, the clad wire may be reduced in diameter, for example, via a drawing process. Additionally or alternatively, the clad wire may be reduced in diameter via a swaging process. Step 202 may be described as reducing a standard gauge clad wire from a standard gauge diameter to a reduced diameter, with such reduced diameter corresponding at least approximately to a diameter associated with a standard caliber bullet. In other words, the diameter of a length of standard gauge clad wire may be reduced so that it corresponds to a desired diameter of a bullet. Methods 200 may be particularly well-suited for producing so-called non-expanding, or solid bullets, such as in calibers less than about 0.35 inches in diameter; however, methods 200 are not limited to producing such bullets, and non-solid bullets and bullets having a caliber larger than 0.35 inches also may be formed by methods 200 according to the present disclosure.

In some methods 200 according to the present disclosure, it may be desirable to heat treat the clad wire, as optionally indicated at 204 in FIG. 2, after the clad wire has been reduced in diameter. For example, the drawing or swaging process may impart properties to the clad wire, and/or the clad wire may have properties prior to step 202, that are undesirable for bullets. Illustrative, non-exclusive examples of such properties may include (but are not limited to) the hardness and/or the ductility of the clad wire. Additionally or alternatively, the reducing step may have an undesired effect on the bonding between the inner core and the cladding of the clad wire. Heat treating, therefore, may enable a manufacturer to control desired properties of the bullets being formed, and annealing is an illustrative, non-exclusive example of a heat treating process that may be appropriate in some methods according to the present disclosure. Additionally or alternatively, a heat treating step may be performed at any suitable point in a method 100 according to the present disclosure, including at the point illustrated and/or after one or more other steps including after a final configuration of a bullet, or other projectile, has been formed.

As discussed herein, clad wire is often manufactured in bulk, for example, as electrical conductors. Often, such bulk produced clad wire is coiled on spools and may be purchased in a coiled configuration. Accordingly, it may be desirable in some methods according to the present disclosure to first straighten the clad wire as schematically and optionally indicated at 206 in FIG. 2, prior to the drawing step 202. However, methods according to the present disclosure are not limited to utilizing coiled clad wire, and clad wire may be produced, distributed, and/or obtained in a straight bar, or rod configuration. Furthermore, when a straightening step is utilized, it optionally may be performed after the drawing step (or in the case of FIG. 5, the upsetting step). Moreover, an initial straightening step 206 is not necessarily required, even when a coiled clad wire is utilized. For example, depending on such factors as the radius of curvature of the coiled clad wire and additional steps of methods according to the present disclosure, which may straighten the clad wire as a result of the additional steps, an initial straightening step may not be required. Furthermore, in methods 200 that include an optional heat treating step 204, it may be desirable to maintain the clad wire in a coiled configuration to facilitate the heat treatment thereof. For example, it may be easier to implement a heat treating step when an entire coil of clad wire may be easily positioned in a heat treating apparatus, such as an oven. However, it is also within the scope of the present disclosure that heat treatment may be performed on straight lengths of clad wire, including long lengths of straight clad wire, such as that is fed through a heat treatment apparatus.

As indicated at 208 in FIG. 2, some methods 200 according to the present disclosure may optionally include a cutting step, for example to cut the clad wire into a bullet length, that is, into a length corresponding to a desired configuration of bullet being formed. Step 208 is indicated in dashed lines as an optional step because a distinct cutting step may not be required, and other steps, including optional steps of methods 200, may result in the clad wire being cut to a bullet length, or otherwise resulting in a length of clad wire being removed from the supply of clad wire. The cutting step 208 may alternatively refer to an optional step in which a length of clad wire is cut from the supply of clad wire that is greater than a single bullet length, for example to permit easier manipulation of the clad wire for subsequent steps of the method.

Some methods 200 according to the present disclosure may include a working step 210. By working, it is meant that the clad wire, or a portion thereof, may be worked into a near-final configuration of a bullet. Illustrative, non-exclusive examples of working processes include (but are not limited to) heading, swaging, and rolling to form a near-final configuration of a bullet. By near-final configuration, it is meant that the general shape and size of the bullet may be generally formed out of the clad wire, but that further refinement, such as to have the bullet within acceptable tolerances, to add additional features to the bullet, etc. may be performed subsequent to the working step 210. As an illustrative, non-exclusive example, a length of clad wire may be rolled to form a series of interconnected cylindrical portions, with each portion corresponding to a bullet length. Additionally or alternatively, a working step may form the nose of the bullet, with subsequent steps refining the desired configuration of the bullet being formed.

As illustrated in FIG. 2, methods 200 according to the present disclosure typically include a machining, or finishing, step 212, in which a length of the clad wire is machined, or otherwise modified, to generally form a final configuration of the bullet. For example, one or more of the length of the bullet, the diameter or the bullet, and the size and shape of the nose of the bullet may be machined or otherwise finished to a desired configuration, such as (but not necessarily) corresponding to a standard caliber bullet. By final configuration it is meant that after the machining step 212, the bullet is at least generally in the form of a bullet, and in some methods according to the present disclosure the bullet, after this step, may be configured, or may be ready, to be utilized, such as by being loaded into a cartridge.

However, as indicated optionally at 214 in FIG. 2, it is also within the scope of methods 150 according to the present disclosure, that subsequent to the machining and/or other steps discussed herein, the outer surface of the bullet may be treated. For example, the bullet may be coated, such as including one or more of electroplating, painting, passivating, and plastic coating. Such coatings, for example, may impart a corrosion-resistant coating to the bullet, which may be desirable in some implementations of methods according to the present disclosure. For example, when steel clad wire is utilized in a method according to the present disclosure, it may be desirable to prevent, or at least restrict, oxidation of any exposed steel from the inner core of the clad wire that was utilized to form the bullet. Other coatings and reasons for coating bullets are also within the scope of the present disclosure.

Finally, as indicated optionally at 216 in FIG. 2, it is within the scope of methods 150 according to the present disclosure to include a loading step, that is, a step to load the bullet into a cartridge, such as into a standard caliber firearm cartridge. This step is optional, as a large population of firearm enthusiasts prefer to load, and reload, their own cartridges for various reasons.

Figure 3:
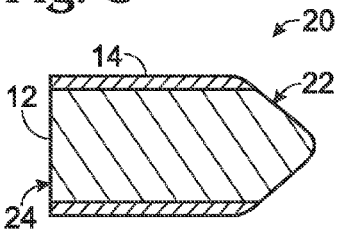
FIG. 3 is a schematic cross-sectional view of an illustrative, non-exclusive example of a bullet according to the present disclosure, and which may be formed according to methods according to the present disclosure.

FIG. 3 schematically illustrates in cross-section, an illustrative, non-exclusive example of a bullet 20 according to the present disclosure. Bullet 20 is an example of a bullet that may be formed according to a method 200 according to the present disclosure. As illustrated, bullet 20 includes a core and an outer layer corresponding to the inner core 12 and cladding 14, respectively, of the clad wire from which it was formed. Bullet 20 includes a nose 22 and a heel 24, in which the metal from the inner core of the clad wire is exposed. Such a configuration may result depending on the specific steps utilized during a method 200. For example, the nose 22 of the bullet may have been formed by direct machining of a length of clad wire, during a step 212. Such a machining step may remove the cladding 14 from the portion of the length of clad wire that became the nose of the bullet 20.

In examples in which steel clad wire is utilized to form a bullet 20 according to the present disclosure, it may be desirable to include a surface treating step 214, such as to prevent, or at least restrict, oxidation of the exposed steel from the inner core of the steel clad wire. Surface treating of such exposed regions also may be performed for aesthetic purposes. However, as mentioned, such surface treatment step is optional and not required to all methods 150 according to the present disclosure.

Figure 4:
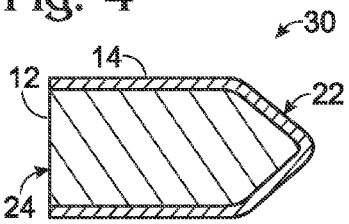
FIG. 4 is a schematic cross-sectional view of another illustrative, non-exclusive example of a bullet according to the present disclosure, and which may be formed according to methods according to the present disclosure.

FIG. 4 schematically illustrates in cross-section, another illustrative, non-exclusive example of a bullet according to the present disclosure, with the bullet of FIG. 4 being indicated generally at 30. As schematically illustrated, bullet 30 differs from bullet 20 of FIG. 3 in that the cladding 14 of the clad wire extends at least substantially over the nose 22 of the bullet. Such a configuration may result depending on the specific steps utilized during a method 150. For example, the nose 22 of the bullet may have been formed during an optional working step 210, with such working step including a process in which the cladding 14 remains on the outer surface of the nose. An illustrative, non-exclusive example of a suitable working process that may result in such a configuration includes rolling. Additionally or alternatively, a working step may include pinching the clad wire so that the cladding of the clad wire wraps around a substantial portion of the inner core to form a nose of the bullet being formed. Other working processes, including processes resulting in a bullet 30, are also within the scope of the present disclosure.

Turning now to the flowchart of FIG. 5, additional illustrative, non-exclusive examples of methods 150 according to the present disclosure are schematically illustrated and are indicated generally at 300. Methods 300 according to the present disclosure may be described as methods of forming bullets in which the diameter of the clad wire being utilized, such as standard gauge clad wire, is increased, or enlarged, to correspond to a desired diameter, such as that of a desired caliber bullet to be formed. Accordingly, as illustrated at 302, a length of clad wire is upset, increased, or enlarged in diameter by any suitable process. As an illustrative, non-exclusive example, a length of clad wire may be compressed in a die with a punch, but other processes of upsetting, or enlarging, the diameter of a length of clad wire are also within the scope of methods 300 according to the present disclosure. Step 302 may be described as enlarging a diameter of a length of clad wire from a standard gauge diameter to an enlarged diameter, such as corresponding at least approximately to a diameter associated with a standard caliber firearm bullet. Methods 300 may be particularly well suited for producing non-expanding, or solid bullets in calibers greater than about 0.35 inches in diameter; however, methods 300 may be utilized to form bullets of any suitable size, including those of calibers less than 0.35 inches in diameter. Referring back to Table 1, it can be seen that a #0 AWG clad wire, which is typically the largest common gauge of solid clad wire, has a diameter of approximately 0.325 inches, whereas larger electrical conductors are typically formed from braided cables or ropes of several individual strands of smaller wire. Accordingly, commodity pricing of clad wire with diameters greater than a #0 AWG clad wire may not be generally available, and methods 300 according to the present disclosure may be utilized to produce bullets of a caliber having diameters greater than 0.325 inches.

In some methods 300 according to the present disclosure, the upsetting step 302 may be described as altering the dimensions of a cylinder formed from a length of clad wire. For example, in some methods 300, the length of a cylinder is decreased and the diameter of the cylinder is increased. In some such versions of methods 300, the upsetting step is used exclusively to define a desired diameter of the length of clad wire and no other features of the bullet are formed during the step. However, it is also within the scope of the present disclosure that an upsetting step, in addition to increasing the diameter of the length of clad wire, forms other aspects and/or characteristics of the bullet being formed. This may be described as working the clad wire into a near-final configuration, similar to the step 210 discussed above with respect to methods 200 according to the present disclosure, such as forming at least a nose of the bullet. For example, the upsetting step may utilize a die that is bullet shaped and that defines at least a bullet nose shape, such as a conical or frustoconical end region, as opposed to merely cylindrical in shape. Utilizing an upsetting step that forms a near-final configuration of a bullet being formed may enable formation of a bullet 30 as illustrated in FIG. 4, in which the cladding of the clad wire extends at least substantially over the nose 22 of the bullet. This configuration may result, for example, as the cylindrical length of clad wire is pressed, or compressed, into a bullet shaped die, and the cladding of the clad wire is pinched into the cone-shaped or frustoconical portion of the die. In contrast, an upsetting step, in which an altered cylinder is formed (e.g., without a conical or frustoconical end region) from the length of clad wire may require subsequent machining to form the nose of the bullet, and therefore may result in a bullet 20 as schematically illustrated in FIG. 3.

Although not required, it may be desirable to first cut an individual length of clad wire, as indicated in FIG. 5 at 304. For example, this may be helpful if it is difficult or less practical to upset a supply of clad wire, such as a spool of coiled clad wire or even an elongate length of clad wire. A suitable length of clad wire may be selected such that during the upsetting step 302, an appropriate bullet length is formed.

As discussed, clad wire is often supplied in a coiled configuration, and therefore in some methods 300 according to the present disclosure, it may be desirable to first straighten the clad wire, as schematically and optionally indicated at 206 in FIG. 5, prior to cutting individual lengths of clad wire. However, depending on such factors as the radius of curvature of the coiled clad wire, the length of bullet being formed, the particular upsetting process being utilized, a straightening step may not be needed.

Depending on the desired properties of the bullet being formed, and depending on the upsetting process being utilized as part of a method 300, it may be desirable to heat treat the length of clad wire after it has been upset, as schematically and optionally indicated at 204 in FIG. 5. Heat treatment also may be desirable in such circumstances in which the upsetting process may affect the bonding between the inner core and the cladding of the clad wire. Annealing is an illustrative, non-exclusive example of a heat treating process that may be suitable, but other heat treating processes are also within the scope of the present disclosure.

As illustrated in FIG. 5, methods 300 according to the present disclosure may include a machining, or finishing, step 212, in which the upset length of clad wire is machined, or otherwise modified, to generally form a final configuration of the bullet being formed. This machining step is similar to the machining step 212 discussed herein with respect to methods 200 according to the present disclosure, and may result in a bullet 20 or a bullet 30, for example, depending on the upsetting step 302 discussed herein.

As indicated optionally at 214 in FIG. 5, it is also within the scope of methods 300 according to the present disclosure, that subsequent to the machining and/or other steps discussed herein, the outer surface of the bullet may be treated. For example, the bullet may be coated, such as including one or more of electroplating, painting, passivating, and plastic coating. As discussed herein, such coatings may impart a corrosion-resistant coating to the bullet, which may be desirable in some implementations of methods according to the present disclosure.

Finally, as indicated optionally at 216 in FIG. 5, it is within the scope of methods 300 according to the present disclosure to include a loading step to load the formed bullet into a cartridge, such as into a standard caliber firearm cartridge.

Figure 6:
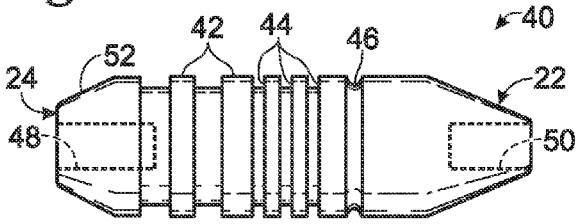
FIG. 6 is a schematic side view of a bullet according to the present disclosure illustrated with various optional features, and which may be formed according to methods according to the present disclosure.

Turning now to FIG. 6, a less schematic illustration of a bullet 40 is provided and includes various optional features of bullets according to the present disclosure, with such various optional features optionally being formed during one or more steps of methods 150 according to the present disclosure. As illustrative, non-exclusive examples, bullet 40 is illustrated as including driving bands 42, grooves 44, a cannelure 46, a heel cavity 48, a nose cavity 50, and a boat-tail 52. Nose cavities, when present, define what are generally referred to as hollow-point bullets and may be left void or, alternatively, may be filled with soft metal, plastic, or other material that is configured to facilitate expansion and/or fragmentation of the bullet upon impact with soft targets. Optional heel cavities, when present, may be filled with a metal, or other material, having a greater density than that of the clad wire's inner core, for example, to configure a desired mass distribution along the length of the bullet.

One or more of these various optional features of bullets discussed may be formed during, for example, a working step, an upsetting step, a machining step, and/or an additional step performed after the discussed steps of methods 150 according to the present disclosure. It is within the scope of the present disclosure, however, that bullets formed according to methods 150 not include any of these various additional and optional features.

Figure 7:
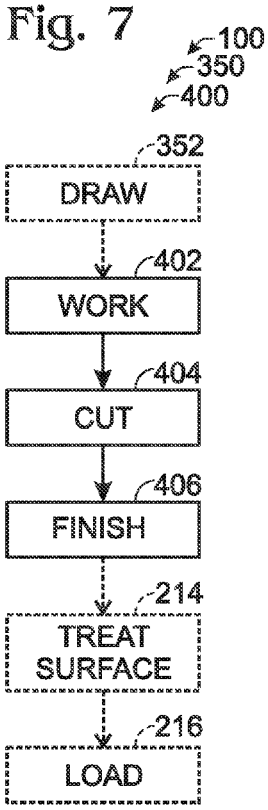
FIG. 7 is a flowchart schematically illustrating illustrative, non-exclusive examples of methods of forming shot according to the present disclosure.
Figure 10:
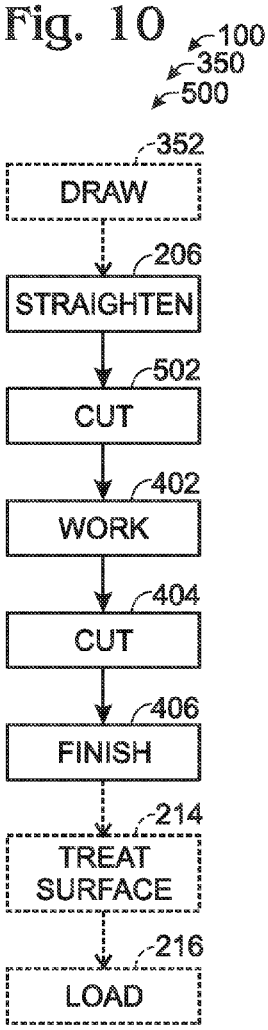
FIG. 10 is a flowchart schematically illustrating additional illustrative, non-exclusive examples of methods of forming shot according to the present disclosure.
Figure 11:
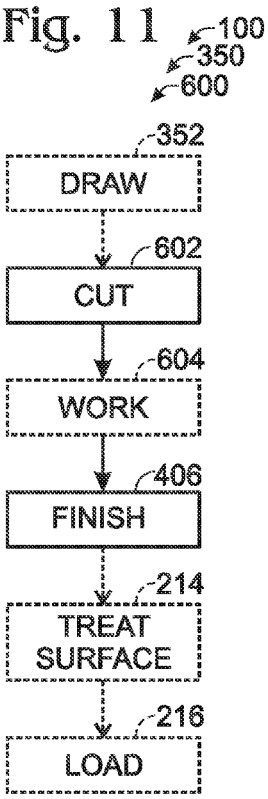
FIG. 11 is a flowchart schematically illustrating additional illustrative, non-exclusive examples of methods of forming shot according to the present disclosure.

The methods 100 illustrated in the flowcharts of FIGS. 7 and 10-11 are examples of methods 100 in which ammunition shot is formed. These methods are indicated generally at 350 in FIGS. 7 and 10-11 and may more specifically be described as methods of forming ammunition shot from a length of clad wire. The three flowcharts of FIGS. 7 and 10-11 illustrate various steps, some of which are common to the three illustrated flowcharts and others which are exclusive to only one or two of the illustrated flowcharts. However, as discussed herein, it is within the scope of the present disclosure that various steps of one illustrated flowchart may also be utilized in the method of another illustrated flowchart, and methods according to the present disclosure are not limited exclusively to the illustrated steps of each flowchart. All three of the illustrated methods of FIGS. 7 and 10-11 include an optional step 352, in which clad wire is first drawn, swaged, or otherwise reduced in diameter to a desired size of ammunition shot. Step 352 may be described as reducing a standard gauge clad wire from a standard gauge diameter to a reduced diameter, with such reduced diameter corresponding at least approximately to a desired diameter of the ammunition shot being formed. This step is optional, however, as it is also within the scope of the present disclosure that ammunition shot be formed with diameters generally corresponding to standard gauge clad wire. Moreover, as discussed herein, it is also within the scope of the present disclosure that clad wire be formed with a desired diameter corresponding to a desired diameter of projectile (e.g., ammunition shot) that does not necessarily correspond to a standard gauge of clad wire.

Referring first to FIG. 7, which illustrates a first method 400 of forming ammunition shot, a length of clad wire is worked to form a string of interconnected beads, as indicated at 402, such as in which each bead has a dimension generally corresponding to a desired diameter of the ammunition shot being formed. That is, a string of beads is formed in which generally spherical pellets, or shot, are interconnected by generally cylindrical connecting portions of the clad wire that are reduced in diameter during the working step. Examples of suitable working processes include (but are not limited to) roll-forming, heading, and stamping.

Figure 8:
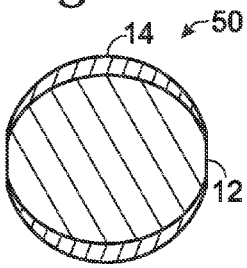
FIG. 8 is a schematic cross-section view of an illustrative, non-exclusive example of a shot according to the present disclosure, and which may be formed according to methods according to the present disclosure.

Methods 400 according to the present disclosure will typically include a cutting step 404, as optionally illustrated in FIG. 7, to separate the individual beads, or pellets, from each other. The cutting may include a shearing process, for example, resulting in a generally flat, or planar, separation surface, in which the inner core material of the clad wire is at least partially exposed. An example of an individual shot, or pellet, with these characteristics is schematically illustrated in cross-section in FIG. 8 and is indicated generally at 50. Despite the potential for flat surfaces having exposed metal from the inner core of the clad wire, this exposed inner core metal will not actually be permitted (or substantially will not be permitted) to come into contact with the inside surface of a firearm barrel, simply due to the geometric shape of the individual pellet and the cylindrical inside surface of a firearm barrel. Accordingly, even when utilizing a steel clad wire, in which the steel is generally thought to be potentially damaging to the inside surface of a firearm barrel, the steel of a shot 50 will not actually come into contact with the inside surface of the barrel.

Additionally or alternatively, the individual beads may be pinched from the string of beads during the cutting step, such as utilizing a rolling process, for example, resulting in a more spherical pellet in which the cladding of the clad wire wraps around the metal from the inside of the clad wire so that individual pellets substantially do not include exposed metal from the inner core of the clad wire. An example of an individual pellet, or shot, with these characteristics is schematically illustrated in cross-section in FIG. 9 and is indicated generally at 60.

Next, as indicated at 406, the individual pellets cut from the string of beads may be further refined, rounded, or finished, into a more spherical shape. An illustrative, non-exclusive example of a suitable finishing process includes tumbling the individual pellets; however, any other appropriate process for generally refining or rounding the individual pellets into a desired shape for ammunition shot is also within the scope of the present disclosure.

The optional step 214 of treating the surface of the formed ammunition shot may be performed. Examples of surface treating processes include (but are not limited to) electroplating, painting, passivating, and plastic coating. Such processes may be performed for functional purposes such as to import a corrosion-resistant coating to the shot and/or for aesthetic purposes, such as in the example of forming a shot 50, in which the inner metal of the clad wire is at least partially exposed. Despite the geometric limitations of this exposed inner metal being able to contact the inside surface of a firearm barrel, some consumers, such as those that load their own cartridges, may find the appearances of shot 50 less than optimal, when in fact they may function just as well as traditional shot and shot 60 according to the present disclosure.

Finally, it is within the scope of methods 350 according to the present disclosure to include a loading step 216 to load the formed ammunition shot into a cartridge, such as into a standard caliber shotgun cartridge. This step is optional, however, because shot is often sold in bulk, for example, for consumers to load, and reload, their own cartridges.

Still referring to FIG. 7, it is noted that a straightening step is not illustrated. Accordingly, methods 400 may be utilized with clad wire that is already straight, such as that is manufactured, or least received in a straight, bar, or rod configuration. The flowchart of FIG. 7, however, also illustrates methods 400 in which coiled clad wire is utilized and a straightening step is simply not required. In such examples, the methods may be described as coil-fed methods, and the working step 402 and cutting step 404 may be appropriately configured so that coiled clad wire may be utilized as a supply of clad wire.

Turning now to the flowchart of FIG. 10, a second method 350 according to the present disclosure is schematically illustrated and is indicated generally at 500. Methods 500 according to the present disclosure include a straightening step 206, which, as discussed herein, may be utilized when a supply of coiled clad wire is used. After straightening the coiled clad wire, the clad wire may then be cut into lengths of straight clad wire, as indicated at 502. These lengths of straight clad wire may be of any suitable length that is appropriate for facilitating subsequent steps of methods 500. As an illustrative, non-exclusive example, lengths of approximately 12 feet may be suitable; however, lengths greater than and less than 12 feet also may be used.

After the cutting step 502 of methods 500, the lengths of clad wire may then be worked, cut and finished into individual pellets, or shot, utilizing steps 402, 404, and 406, respectively. However, because the clad wire is not maintained in a coiled configuration, a method 500 may be described as a bar-, or rod-, fed method. Optional surface treating and loading steps 214 and 216, respectively, are also illustrated in the flowchart of FIG. 10 and are within the scope of methods 500 according to the present disclosure.

Figure 9:
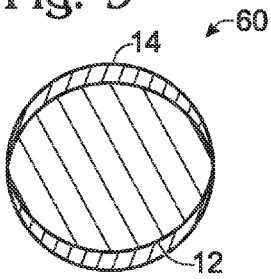
FIG. 9 is a schematic cross-section view of an illustrative, non-exclusive example of another shot according to the present disclosure, and which may be formed according to methods according to the present disclosure.

The flowchart of FIG. 11 schematically illustrates yet another variation of methods 350 of forming ammunition shot. Specifically, FIG. 11 illustrates a method 600 in which a cutting step 602 cuts off an individual pellet mass from a supply of clad wire, for example, corresponding to a desired mass of ammunition shot being formed. This cutting step may result in a generally cylindrical length of clad wire, such as by utilizing a shearing process to cut off the individual pellet masses. Additionally or alternatively, a rolling, or other process, may be utilized in which lengths of clad wire are pinched off, resulting in the cladding of the clad wire wrapping around at least a portion, and optionally a substantial portion, of the inner core of the clad wire, thereby resulting in little, and optionally substantially none, of the metal of the inner core being exposed on the outer surface of the individual pellet masses after the cutting step. This optional process may result in ammunition shot 60, such as schematically illustrated in FIG. 9 and discussed herein, being formed.

Following the cutting step, a working step 604 may then be performed on the individual pellet masses, as illustrated in FIG. 11. This working step may, for example, include heading or swaging the pellet masses to round them into a generally spherical shape. This working step is illustrated as optional in FIG. 11, because depending on the form of the pellet masses resulting from the cutting step, a further rounding of the pellet masses may not be required. For example, as mentioned, the cutting step itself may result in a generally spherical pellet. Finally, the individual pellets may be finished and optionally treated and loaded in steps 406, 214, and 216, respectively, as illustrated in FIG. 11.

In addition to the various specific processes and steps of methods illustrated in the flowcharts of the Figures and discussed herein, other optional processes may be utilized in the forming of ammunition projectiles pursuant to methods according to the present disclosure. As illustrative, non-exclusive examples, the following paragraphs discuss a few of such optional processes that are within the scope of the present disclosure and that may be incorporated into methods according to the present disclosure.

(1) Alternate clad alloys may be used in copper-clad steel production runs without significantly modifying equipment. For example, copper alloy (e.g., 95Cu-5Zn "gilding metal") may be substituted for normal high-conductivity grades of pure copper.

(2) If conventional pure copper cladding is found to be too soft for a particular ammunition projectile type, surface hardening may be accomplished by shot-peening, burnishing, et al.

(3) Whereas plain-carbon steels such as AISI 1006 and AISI 1022 are conventionally used for electrical copper-clad steel wire core material, substituting alternate types of steel (e.g., free-machining grades) is an available option.

(4) Properties of cladding and/or core materials may be modified by different types of metal-working, heat-treating, and/or combinations thereof, provided that good metallurgical practices are followed for both material types of the composite. For example, if it were desirable to anneal a copper-clad steel bullet consisting of pure, high-conductivity electrolytic tough pitch (ETP) copper over a steel core, consideration would need to be given to final annealing atmosphere. Using a reducing-gas atmosphere (to minimize steel oxidation) could potentially result in stress-corrosion-cracking of ETP copper, induced by the reduction of copper-oxide precipitates at grain boundaries. In this example, a remedy may be to substitute oxygen-free, high-conductivity (OFHC) copper as cladding.

(5) In addition to conventional coatings and lubricants (e.g., for corrosion-resistance), the use of additional surface coatings, such as stearates, molybdenum-disulfide, graphite, polymeric films, et al. may advantageously reduce friction, barrel fouling, etc.

Because of the availability of many processing options for the various methods of the present disclosure, it is within the scope of the present disclosure to design customized fabrication processes to be design-specific for individual customer specifications. For example, if a customer desires a rifle bullet for extremes of velocity and barrel "twist rate" (barrel length, in inches, per revolution) with exceptionally high penetrating strength, one may select a work-hardened copper-zinc alloy cladding over a higher-carbon or alloy steel (properly heat-treated). It is within the scope of the present disclosure to supply customized clad wire bullet "starting blanks" to specific customer specifications and bullet designs, such as to enable customers to produce their own proprietary ammunition projectiles.

Illustrative, non-exclusive examples of inventions according to the present disclosure are presented in the following enumerated sentences. It is within the scope of the present disclosure that an individual step of a method recited herein, including in the following enumerated sentences, may additionally or alternatively be referred to as a "step for" performing the recited action.

A A method, comprising:

forming a bullet from a length of clad wire, wherein the bullet is configured to be received within a standard caliber firearm cartridge.

A1 The method of paragraph A, wherein the clad wire is clad steel wire.

A1.1 The method of paragraph A1, wherein the clad steel wire is one of copper-clad steel wire, aluminum-clad steel wire, tin-clad steel wire, and zinc-clad steel wire.

A1.2 The method of paragraph A1, wherein the clad steel wire is copper-clad steel wire.

A1.2.1 The method of paragraph A1.2, wherein the thickness of the copper cladding of the copper-clad steel wire is at least one of at least 2%, at least 3%, at least 5%, at least 7%, at least 9%, between about 2% and about 10%, about 3%, about 6.5%, and about 10% of the diameter of copper-clad steel wire.

A2 The method of any of paragraphs A-A1.2.1, wherein the length of clad wire is from a supply of coiled clad wire.

A2.1 The method of paragraph A2, further comprising:

prior to the forming, straightening the length of clad wire.

A3 The method of any of paragraphs A-A2.1, wherein the forming includes:

reducing a standard gauge clad wire from a standard gauge diameter to a reduced diameter.

A3.1 The method of paragraph A3, wherein the reduced diameter corresponds at least approximately to a diameter associated with the standard caliber firearm cartridge.

A3.2 The method of any of paragraphs A3-A3.1, wherein the reducing includes drawing the standard gauge clad wire.

A3.3 The method of any of paragraphs A3-A3.2 (only when depending from paragraph A2 and not depending from paragraph A2.1), wherein the forming further includes:

after the reducing, straightening the length of clad wire.

A4 The method of any of paragraphs A-A3.3, wherein the forming includes:

(after the steps of any of paragraphs A3-A3.2 and prior to the step of paragraph A3.3 when depending therefrom) heat-treating the clad wire.

A4.1 The method of paragraph A4, wherein the heat-treating includes annealing.

A5 The method of any of paragraphs A-A4, wherein the forming includes:

(after the steps of any of paragraphs A3-A4.1 when depending therefrom) cutting the clad wire into a bullet length.

A6 The method of any of paragraphs A-A5, wherein the forming includes:

(after the steps of any of paragraphs A3-A5 when depending therefrom), working the clad wire into a near-final configuration of the bullet.

A6.1 The method of paragraph A6, wherein the working includes at least one of heading, swaging, and rolling to form the near-final configuration of the bullet.

A6.2 The method of any of paragraphs A6-A6.1, wherein the working includes forming a nose of the bullet.

A6.2.1 The method of paragraph A6.2, wherein the forming includes forming the nose of the bullet so that the cladding of the clad wire remains on at least a substantial portion of an outer surface of the nose of the bullet.

A7 The method of any of paragraphs A-A2.1, wherein the forming includes:

enlarging a diameter of a length of clad wire from a standard gauge diameter to an enlarged diameter.

A7.1 The method of paragraph A7, wherein the enlarged diameter corresponds at least approximately to a diameter associated with the standard caliber firearm cartridge.

A7.2 The method of any of paragraphs A7-A7.1, wherein the enlarging includes compressing the length of clad wire in a die with a punch.

A7.3 The method of any of paragraphs A7-A7.2, wherein the forming further includes:

prior to the enlarging, cutting the length of clad wire from a supply of clad wire.

A7.4 The method of any of paragraphs A7-A7.3, wherein the forming further includes:

after the enlarging, heat treating the length of clad wire.

A7.4.1 The method of paragraph A7.4, wherein the heat treating includes annealing.

A8 The method of any of paragraphs A-A7.4.1, wherein the forming includes:

(after the steps of any of paragraphs A2-A7.4.1 when depending therefrom) machining the length of clad wire.

A8.1 The method of paragraph A8, wherein the machining includes machining to form a final configuration of the bullet.

A8.1.1 The method of paragraph A8.1, wherein the final configuration includes at least a nose.

A8.1.1.1 The method of paragraph A8.1.1, wherein the final configuration includes one or more of a driving band, a groove, a cannelure, a heel cavity, a nose cavity, and a boat tail.

A8.1.1.2 The method of any of paragraphs A8.1.1-A8.1.1.1, wherein the nose includes exposed metal from the inside of the clad wire.

A9 The method of any of paragraphs A-A8.1.1.2, wherein the forming further includes:

(after the steps of any of paragraphs A2-A7.1.1.2 when depending therefrom) coating the bullet.

A9.1 The method of paragraph A9, wherein the coating includes one or more of electroplating, painting, passivating, and plastic coating.

A9.2 The method of any of paragraphs A9-A9.1, wherein the coating includes imparting a corrosion-resistant coating to the bullet.

A10 The method of any of paragraphs A-A9.1, further comprising:

prior to the forming, obtaining a supply of the clad wire from a third party.

A10.1 The method of paragraph A10, wherein the third party manufactures the clad wire as electrical wire.

A11 The method of any of paragraphs A-A9.2, wherein the forming includes:

manufacturing the clad wire.

A11.1 The method of paragraph A11 (when not depending from any of paragraphs A3-A3.3 and A7-A7.4.1), wherein the clad wire has a diameter suitable for forming the bullet without requiring the steps of either of paragraphs A2 or A3.

A12 The method of any of paragraphs A-A11.1, further comprising:

after the forming, loading the bullet into a standard caliber firearm cartridge.

A12.1 A firearm cartridge manufactured according to the method of paragraph A12.

A13 A firearm cartridge containing a bullet manufactured according to the method of any of paragraphs A-A11.1

A14 A bullet manufactured according to the method of any of paragraphs A-A11.1

B A method, comprising:

forming ammunition shot from a length of clad wire.

B1 The method of paragraph B, wherein the clad wire is clad steel wire.

B1.1 The method of paragraph B1, wherein the clad steel wire is one of copper-clad steel wire, aluminum-clad steel wire, tin-clad steel wire, and zinc-clad steel wire.

B1.2 The method of paragraph B1, wherein the clad steel wire is copper-clad steel wire.

B1.2.1 The method of paragraph B1.2, wherein the thickness of the copper cladding of the copper-clad steel wire is at least one of at least 2%, at least 3%, at least 5%, at least 7%, at least 9%, between about 2% and about 10%, about 3%, about 6.5%, and about 10% of the diameter of copper-clad steel wire.

B2 The method of any of paragraphs B-B1.2.1, wherein the length of clad wire is from a supply of coiled clad wire.

B2.1 The method of paragraph B, further comprising:

prior to the forming, straightening the length of clad wire.

B2.1.1 The method of paragraph B2.1, further comprising:

after the straightening, cutting the length of clad wire from the supply of clad wire.

B3 The method of any of paragraphs B-B2.1.1, wherein the forming includes:

working the clad wire into a plurality of interconnected beads, wherein each bead has a dimension generally corresponding to a desired diameter of the ammunition shot.

B3.1 The method of paragraph B3, wherein the working includes one or more of heading and roll-forming to form the plurality of interconnected beads.

B3.2 The method of any of paragraphs B3-B3.1, wherein the plurality of interconnected beads is a plurality of interconnected generally spherical beads.

B3.3 The method of any of paragraphs B-B3.2, wherein the forming further includes:

separating the plurality of interconnected beads into individual pellets.

B4 The method of any of paragraphs B-B2, wherein the forming includes:

cutting individual pellets from the length of clad wire, wherein the length of clad wire generally corresponds to a desired diameter of the ammunition shot.

B4.1 The method of paragraph B4, wherein the forming further includes:

after the cutting, rounding the individual pellets into generally spherical pellets.

B4.1.1 The method of paragraph B4.1, wherein the rounding includes one or more of heading and swaging.

B5 The method of any of paragraphs B3.3-B4.1, wherein the individual pellets are generally spherical.

B6 The method of any of paragraphs B3.3-B5, wherein individual pellets include exposed metal from the inside of the clad wire.

B6.1 The method of paragraph B6, wherein the exposed metal defines generally flat surfaces.

B7 The method of any of paragraphs B3.3-B5, wherein individual pellets substantially do not include exposed metal from the inside of the clad wire.

B7.1 The method of paragraph B7, wherein the forming includes pinching the clad wire to form the individual pellets so that the cladding wraps around the metal from the inside of the clad wire.

B8 The method of any of paragraphs B3.3-B7.1, wherein the forming further includes:

rounding the individual pellets.

B8.1 The method of paragraph B8, wherein the rounding includes tumbling the individual pellets.

B9 The method of any of paragraphs B3.3-B8.1, wherein the forming further includes:

(after the steps of any of paragraphs B3.3-B8.1) coating the individual pellets.

B9.1 The method of paragraph B9, wherein the coating includes one or more of electroplating, painting, passivating, and plastic coating.

B9.2 The method of any of paragraphs B9-B9.1, wherein the coating includes imparting a corrosion-resistant coating to the individual pellets.

B10 The method of any of paragraphs B3-B9.2, wherein the forming further includes:

(prior to the steps of any of paragraphs B3-B9.2 and optionally prior to the step of paragraph B2.1 when depending therefrom) reducing a standard gauge clad wire from a standard diameter to a reduced diameter.

B10.1 The method of paragraph B10, wherein the reduced diameter corresponds at least approximately to a desired diameter of the ammunition shot.

B10.2 The method of any of paragraphs B10-B10.1, wherein the reducing includes drawing the standard gauge clad wire.

B11 The method of any of paragraphs B-B10.2, further comprising:

prior to the forming, obtaining a supply of the clad wire from a third party.

B11.1 The method of paragraph B, wherein the third party manufactures the clad wire as electrical wire.

B12 The method of any of paragraphs B-B10.2, wherein the forming includes:

manufacturing the clad wire.

B12.1 The method of paragraph B12 (when not depending from any of paragraphs B10-B10.2), wherein the clad wire has a diameter corresponding at least approximately to a desired diameter of the ammunition shot.

B13 The method of any of paragraphs B-B12.1, further comprising:

after the forming, loading the ammunition shot into a standard caliber firearm cartridge.

B13.1 A firearm cartridge manufactured according to the method of paragraph B13.

B14 A firearm cartridge containing shot manufactured according to the method of any of paragraphs B-B12.1.

B15 Ammunition shot manufactured according to the method of any of paragraphs B-B12.1.

In the event that any of the references that are incorporated by reference herein define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically created for the purpose of performing the function. It is also within the scope of the present disclosure that elements, components, and/or other recited subject matter that is recited as being adapted to perform a particular function may additionally or alternatively be described as being configured to perform that function, and vice versa.

The disclosure set forth above encompasses multiple distinct inventions with independent utility. While each of these inventions has been disclosed in its preferred form or method, the specific alternatives, embodiments, and/or methods thereof as disclosed and illustrated herein are not to be considered in a limiting sense as numerous variations are possible. This present disclosure includes all novel and non-obvious combinations and subcombinations of the various elements, features, functions, properties, methods, and/or steps disclosed herein. Similarly, where any disclosure above or claim below recites "a" or "a first" element, step of a method, or the equivalent thereof, such disclosure or claim should be understood to include incorporation of one or more such elements or steps, neither requiring nor excluding two or more such elements or steps.

It is believed that the following claims particularly point out certain combinations and subcombinations that are directed to one of the disclosed inventions and are novel and non-obvious. Inventions embodied in other combinations and subcombinations of features, functions, elements, properties, methods, and/or steps may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

INDUSTRIAL APPLICABILITY

The methods and ammunition projectiles of the present disclosure are applicable to the firearm and ammunition fields.

The invention claimed is:

1. A method of forming a bullet from a length of clad wire, the clad wire including an inner core and a cladding surrounding the inner core, wherein the bullet is configured to be received within a standard caliber firearm cartridge, the method comprising:

obtaining a supply of copper-clad steel wire, wherein the copper-clad steel wire was manufactured as a standard gauge electrical wire;

reducing or enlarging the copper-clad steel wire from a standard gauge diameter to a diameter associated with the standard caliber firearm cartridge;

cutting a length of the copper-clad steel wire; and after the reducing or enlarging, performing at least one of working and machining the length of the copper-clad steel wire to form at least a nose of the bullet.

2. A method, comprising:

forming a bullet from a length of clad wire, the clad wire including an inner core and a cladding surrounding the inner core, wherein the bullet is configured to be received within a standard caliber firearm cartridge, wherein the cladding is metallurgically bonded to the inner core and formed from a different composition than the inner core.

3. The method of claim 2, wherein the clad wire is copper-clad steel wire.

4. The method of claim 2, wherein the forming includes:

reducing a standard gauge clad wire from a standard gauge diameter to a reduced diameter, wherein the reduced diameter corresponds at least approximately to a diameter associated with the standard caliber firearm cartridge.

5. The method of claim 2, wherein the forming includes:

cutting the clad wire into a bullet length;

after the cutting, working the clad wire into a near-final configuration of the bullet, wherein the working includes forming a nose of the bullet.

6. The method of claim 5, wherein the working includes forming the nose of the bullet so that the cladding of the clad wire remains on at least a substantial portion of an outer surface of the nose of the bullet.

7. The method of claim 5, wherein the forming further includes:

after the working, machining the clad wire to form at least a nose of the bullet.

8. The method of claim 7, wherein the nose includes exposed metal from the inner core of the clad wire.

9. The method of claim 7, wherein the forming further includes:

after the machining, imparting a corrosion-resistant coating to the bullet.

10. The method of claim 2, wherein the forming includes:

enlarging a diameter of a length of the clad wire from a standard gauge diameter to an enlarged diameter, wherein the enlarged diameter corresponds at least approximately to a diameter associated with the standard caliber firearm cartridge.

11. The method of claim 10, wherein the enlarging includes working the length of clad wire to form at least a nose of the bullet.

12. The method of claim 10, wherein the forming further includes:

after the enlarging, machining the length of the clad wire to form at least a nose of the bullet.

13. The method of claim 2, further comprising:

prior to the forming, obtaining a supply of the clad wire from a third party.

14. The method of claim 13, wherein the third party manufactures the clad wire as electrical wire.

15. The method of claim 2, wherein the forming includes:

manufacturing the clad wire.

16. A bullet manufactured according to the method of claim 2.

17. The method of claim 1, wherein the method includes forming the nose of the bullet so that the cladding of the clad wire remains on at least a substantial portion of an outer surface of the nose of the bullet.

18. The method of claim 1, wherein the nose includes exposed metal from the inner core of the clad wire.

19. The method of claim 1, wherein the method further includes imparting a corrosion-resistant coating to the bullet.

20. A bullet manufactured according to the method of claim 1.

21. The method of claim 1, wherein the cladding is metallurgically bonded to the inner core and formed from a different composition than the inner core.

22. The method of claim 1, wherein the cladding forms a continuous layer around the inner core.

23. The method of claim 2, wherein the cladding forms a continuous layer around the inner core.

24. A method, comprising:

forming a bullet from a length of clad wire, the clad wire including an inner core and a cladding surrounding the inner core, wherein the bullet is configured to be received within a standard caliber firearm cartridge, wherein the forming includes enlarging a diameter of a length of the clad wire from a standard gauge diameter to an enlarged diameter, and further wherein the enlarged diameter corresponds at least approximately to a diameter associated with the standard caliber firearm cartridge.

25. The method of claim 24, wherein the cladding is metallurgically bonded to the inner core and formed from a different composition than the inner core.

26. The method of claim 25, wherein the cladding forms a continuous layer around the inner core.

27. The method of claim 24, wherein the enlarging includes working the length of clad wire to form at least a nose of the bullet.

28. The method of claim 24, wherein the forming further includes:

after the enlarging, machining the length of the clad wire to form at least a nose of the bullet.

29. The method of claim 24, wherein the clad wire is copper-clad steel wire.

30. The method of claim 29, wherein the clad wire is copper-clad steel electrical wire having a standard gauge.

31. The method of claim 24, further comprising:

prior to the forming, obtaining a supply of the clad wire from a third party.

32. The method of claim 31, wherein the third party manufactures the clad wire as electrical wire having a standard gauge.

33. The method of claim 24, wherein the forming includes:

manufacturing the clad wire.

34. A bullet manufactured according to the method of claim 24.

* * * * *